US011549720B2

(12) United States Patent
Pistone et al.

(10) Patent No.: US 11,549,720 B2
(45) Date of Patent: Jan. 10, 2023

(54) REFRIGERATION SYSTEM HAVING DRAIN PAN

(71) Applicant: Emerson Climate Technologies, Inc., Sidney, OH (US)

(72) Inventors: Kenneth A. Pistone, Sidney, OH (US); Nathan P. Burns, Huber Heights, OH (US); Thomas D. Richard, Minster, OH (US); Prashant S. Bharambe, Pune (IN); Stephen J. Walser, Urbana, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 141 days.

(21) Appl. No.: 16/527,967

(22) Filed: Jul. 31, 2019

(65) Prior Publication Data

US 2020/0041165 A1 Feb. 6, 2020

(30) Foreign Application Priority Data

Aug. 2, 2018 (IN) ..... 201821029025
Aug. 8, 2018 (IN) ..... 201824029817

(51) Int. Cl.
*F24F 13/22* (2006.01)
*F25B 39/02* (2006.01)

(52) U.S. Cl.
CPC ..... *F24F 13/22* (2013.01); *F25B 39/02* (2013.01)

(58) Field of Classification Search
CPC ..... F24F 13/22; F24F 13/222; F24F 13/224; F24F 2013/221; F24F 2013/225; F24F 2013/227; F25D 21/14; F25D 2321/14; F25D 2321/141; F25D 2321/144; F25D 2321/1441; F28B 9/08; B60H 1/3233; F25B 39/02
See application file for complete search history.

(56) References Cited

U.S. PATENT DOCUMENTS 2,912,834 A 11/1959 Mann
5,715,697 A * 2/1998 Rust, Jr. ..... F24F 13/22 62/286

(Continued)

FOREIGN PATENT DOCUMENTS

CN 105402876 A 3/2016
CN 105716218 A 6/2016

(Continued)

OTHER PUBLICATIONS

Partial English Machine Translation: DE 202011000568. Accessed via espacenet: Feb. 2021.*

(Continued)

*Primary Examiner* — Tavia Sullens
(74) *Attorney, Agent, or Firm* — Harness, Dickey & Pierce, P.L.C.

(57) ABSTRACT

A refrigeration or climate-control system may include a housing, an evaporator, a drain pan, and a fan. The evaporator may be disposed within the housing and may include a coil positioned in a horizontal orientation. The drain pan may be disposed within the housing and may include an inclined lower wall disposed vertically beneath the coil. The lower wall may define an airflow path underneath the coil. The fan may force the air through the housing and airflow path.

10 Claims, 9 Drawing Sheets

(56) References Cited

U.S. PATENT DOCUMENTS

| | | | | |
|---|---|---|---|---|
| 5,904,053 | A | 5/1999 | Polk et al. | |
| 10,557,644 | B1 * | 2/2020 | Steele | F24F 13/22 |
| 2006/0191289 | A1 * | 8/2006 | Bush | F24F 13/222 62/515 |
| 2007/0000273 | A1 | 1/2007 | Sanders | |
| 2012/0000232 | A1 | 1/2012 | Cieslik et al. | |
| 2020/0041166 | A1 * | 2/2020 | Rokade | F24F 13/222 |

FOREIGN PATENT DOCUMENTS

| | | | | |
|---|---|---|---|---|
| CN | 107091523 | A | 8/2017 | |
| CN | 107327924 | A | 11/2017 | |
| CN | 107449128 | A | 12/2017 | |
| CN | 210569114 | U | 5/2020 | |
| DE | 202011000568 | U1 * | 6/2011 | F24F 13/222 |
| IN | 2600MUMNP2012 | A | 2/2014 | |
| JP | 58150727 | A * | 9/1983 | F24F 13/22 |
| WO | WO-2007000032 | A2 | 1/2007 | |
| WO | WO-2007012157 | A1 | 2/2007 | |

OTHER PUBLICATIONS

Office Action regarding Indian Patent Application No. 201824029817, dated Jun. 9, 2020.
Office Action regarding Indian Patent Application No. 201821029025, dated Aug. 4, 2020.
Office Action regarding Chinese Patent Application No. 201910711725.4, dated Nov. 17, 2020. Translation provided by Unitalen Attorneys at Law.

* cited by examiner

REFRIGERATION SYSTEM HAVING DRAIN PAN

CROSS-REFERENCE TO RELATED APPLICATIONS

This application claims the benefit and priority of Indian Application No. 201821029025 filed Aug. 2, 2018 and Indian Application No. 201824029817 filed Aug. 8, 2018. The entire disclosures of each of the above applications are incorporated herein by reference.

FIELD

The present disclosure relates to a refrigeration system having a drain pan.

BACKGROUND

This section provides background information related to the present disclosure and is not necessarily prior art.

Conventional climate-control or refrigeration systems include evaporators with coils that are mounted vertically or near vertically (i.e., with the long lengths of the coil extending vertically or near vertically) to allow condensate to drip down the coil and into a drain pan. The present disclosure provides a climate-control or refrigeration system with a horizontal evaporator coil with a drain pan positioned underneath the coil. The horizontal configuration of the coil may allow for a larger coil to be used. That is, a system having a horizontal coil can be packaged into a smaller space. The drain pan of the present disclosure is configured to allow air to flow into the drain pan and up into the evaporator.

SUMMARY

This section provides a general summary of the disclosure, and is not a comprehensive disclosure of its full scope or all of its features.

The present disclosure provides a system that may include a housing, an evaporator, a drain pan, and a fan. The evaporator may be disposed within the housing and may include a coil. The drain pan may be disposed within the housing and may include an inclined lower wall disposed vertically beneath the coil. The lower wall may define a first airflow path underneath the coil. The fan may force the air through the housing and the first airflow path.

The inclined lower wall may include a leading edge defining an air inlet into the drain pan. In some configurations, the leading edge includes an airfoil-shaped cross-sectional profile.

In some configurations of the system of either of the above paragraphs, the drain pan includes a pair of opposing side walls and a back wall extending between the side walls.

In some configurations of the system of any of the above paragraphs, the lower wall is attached to the side and back walls.

In some configurations of the system of any of the above paragraphs, the lower wall is angled relative to the back wall.

In some configurations of the system of any of the above paragraphs, the leading edge is disposed at an end of the lower wall opposite an end attached to the back wall.

In some configurations of the system of any of the above paragraphs, the lower wall includes a trough adjacent the leading edge.

In some configurations of the system of any of the above paragraphs, a bottom of the trough is angled relative to the side walls such that the trough is deeper at one of the side walls than at another of the side walls.

In some configurations of the system of any of the above paragraphs, the drain pan includes a deflector disposed within the trough proximate the second one of the side walls.

In some configurations of the system of any of the above paragraphs, a chord length of the airfoil-shaped cross-sectional profile varies across a width of the drain pan.

In some configurations of the system of any of the above paragraphs, an angle of attack of the airfoil-shaped cross-sectional profile varies across a width of the drain pan.

In some configurations of the system of any of the above paragraphs, the leading edge is disposed at a non-perpendicular angle relative to the side walls.

In some configurations of the system of any of the above paragraphs, the back wall of the drain pan and an interior wall of the housing cooperate to define a second airflow path downstream of the first airflow path and the coil.

In some configurations of the system of any of the above paragraphs, the second airflow path receives air from the coil and provides the air to the fan.

In some configurations of the system of any of the above paragraphs, the coil of the evaporator is positioned in a horizontal orientation.

In another form, the present disclosure provides a system that may include a housing, an evaporator, a drain pan, and a fan. The evaporator may be disposed within the housing and may include a coil. The drain pan may be disposed within the housing and may include an inclined lower wall disposed vertically beneath the coil. The drain pan may include a pair of opposing side walls and a back wall extending between the side walls. The lower wall may be attached to the side walls and the back wall. The lower wall may be angled relative to the back wall. The lower wall may define a first airflow path underneath the coil. The fan may force air through the first airflow path. The inclined lower wall may include a leading edge defining an air inlet into the drain pan. The leading edge may include an airfoil-shaped cross-sectional profile.

In some configurations of the system the above paragraph, the leading edge is disposed at an end of the lower wall opposite an end of the lower wall that is attached to the back wall.

In some configurations of the system of either of the above paragraphs, a chord length of the airfoil-shaped cross-sectional profile varies across a width of the drain pan.

In some configurations of the system of any of the above paragraphs, an angle of attack of the airfoil-shaped cross-sectional profile varies across a width of the drain pan.

In some configurations of the system of any of the above paragraphs, the leading edge is disposed at a non-perpendicular angle relative to the side walls.

In some configurations of the system of any of the above paragraphs, the drain pan includes a deflector disposed between the back wall and the leading edge and extending at least partially between the side walls.

In some configurations of the system of any of the above paragraphs, the deflector is sloped so that a size of the deflector reduces as the deflector extends toward one of the side walls.

In some configurations of the system of any of the above paragraphs, the back wall of the drain pan and an interior wall of the housing cooperate to define a second airflow path downstream of the first airflow path and the coil.

In some configurations of the system of any of the above paragraphs, the second airflow path receives air from the coil and provides the air to the fan.

In some configurations of the system of any of the above paragraphs, the lower wall includes a trough adjacent the leading edge.

In some configurations of the system of any of the above paragraphs, a bottom of the trough is angled relative to the side walls such that the trough is deeper at a first one of the side walls than at a second one of the side walls.

In some configurations of the system of any of the above paragraphs, the coil of the evaporator is positioned in a horizontal orientation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 2:
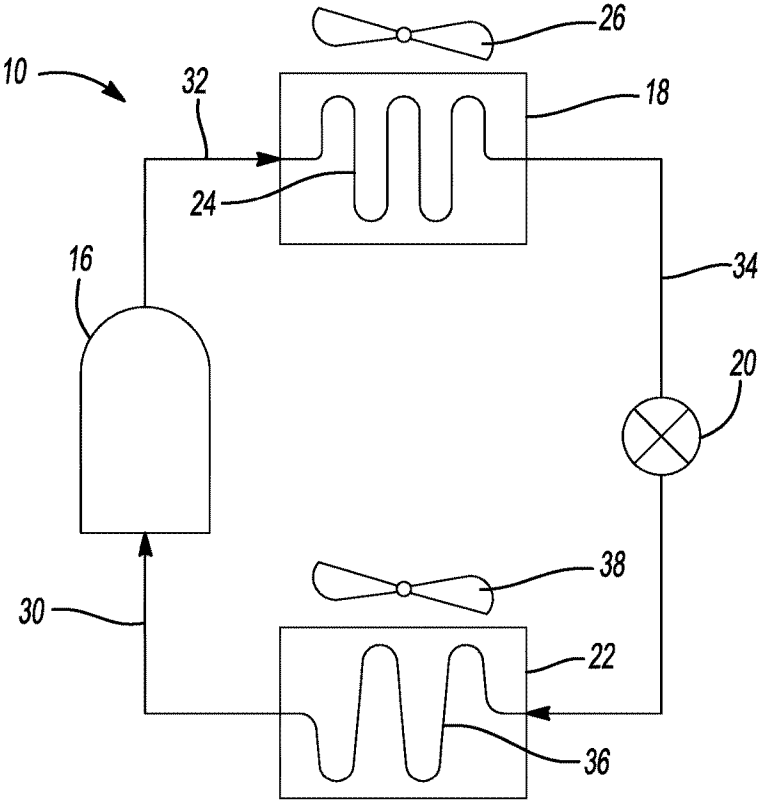
FIG. 2 is a schematic representation of the refrigeration system of FIG. 1.
Figure 1:
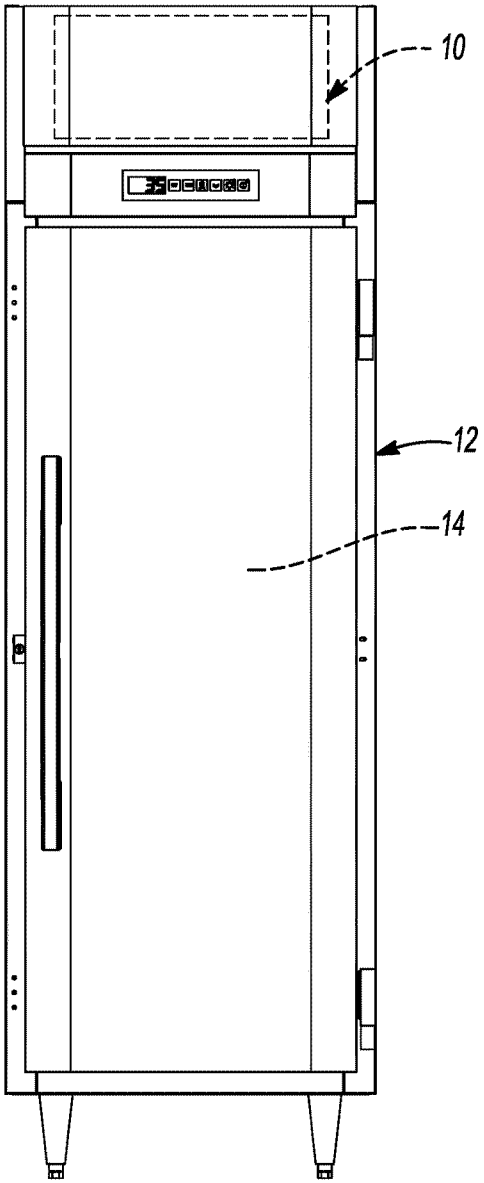
FIG. 1 is a front view of a refrigeration case having a refrigeration system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a climate-control system or refrigeration system 10 is provided that may be mounted to a refrigeration case 12 (FIG. 1) and may be operable to cool a space 14 within the refrigeration case 12. As shown in FIG. 2, the refrigeration system 10 may include a compressor 16, a condenser (or gas cooler) 18, an expansion device 20, and an evaporator 22. The compressor 16 may be any suitable type of compressor, such as a scroll compressor (e.g., including scrolls with intermeshing spiral wraps), a rotary compressor (e.g., with an eccentric rotor rotating within a cylinder, and with a reciprocating vane extending into the cylinder) or a reciprocating compressor (e.g., with a piston reciprocating within a cylinder), for example.

Figure 3:
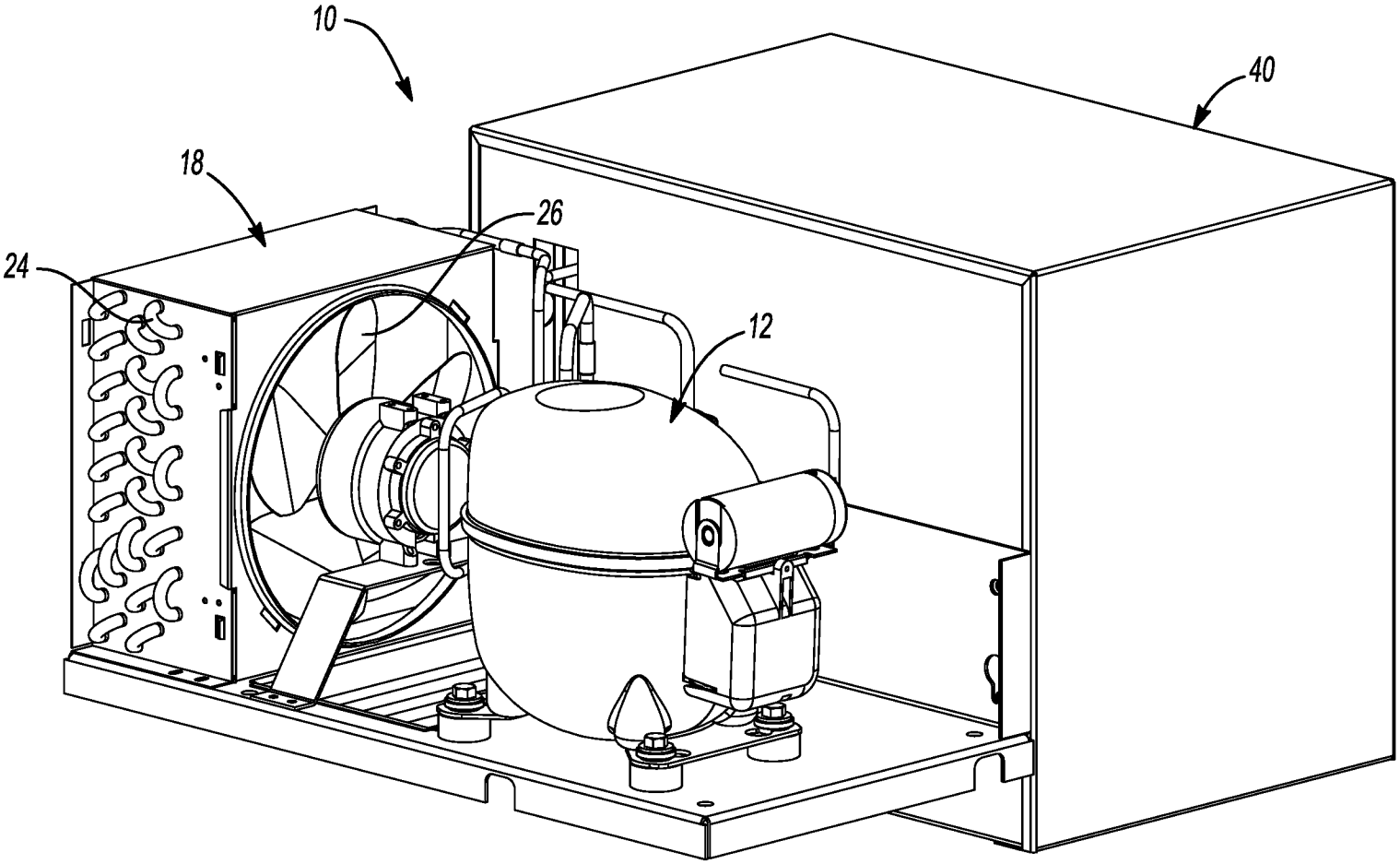
FIG. 3 is a perspective view of the refrigeration system.

During operation of the refrigeration system 10, the compressor 16 may draw suction-pressure working fluid (e.g., refrigerant, carbon dioxide, etc.) from a suction conduit 30 (FIG. 2), compress the working fluid to a higher pressure, and discharge the compressed working fluid into the discharge conduit 32. Working fluid in a discharge conduit 32 (FIG. 2) may flow to the condenser 18, where heat from the working fluid may be transferred to ambient air outside of the refrigeration case 12. As shown in FIG. 3, the condenser 18 may include a coil 24 and a first fan 26 that forces air across the coil 24 to cool the working fluid in the coil 24.

As shown in FIG. 2, a conduit 34 may be fluidly connected to the condenser 18 and the expansion device 20 such that working fluid from exiting the condenser 18 may flow through the conduit 34 to the expansion device 20. The expansion device 20 may be an expansion valve (e.g., a thermal expansion valve or an electronic expansion valve) or a capillary tube, for example. The pressure and temperature of the working fluid drop as the working fluid flows through the expansion device 20. From the expansion device 20, the working fluid may flow through a coil 36 of the evaporator 22, where the working fluid absorbs heat from air from the space 14 of the refrigeration case 12 as a second fan 38 forces air across the coil 36.

Figure 5:
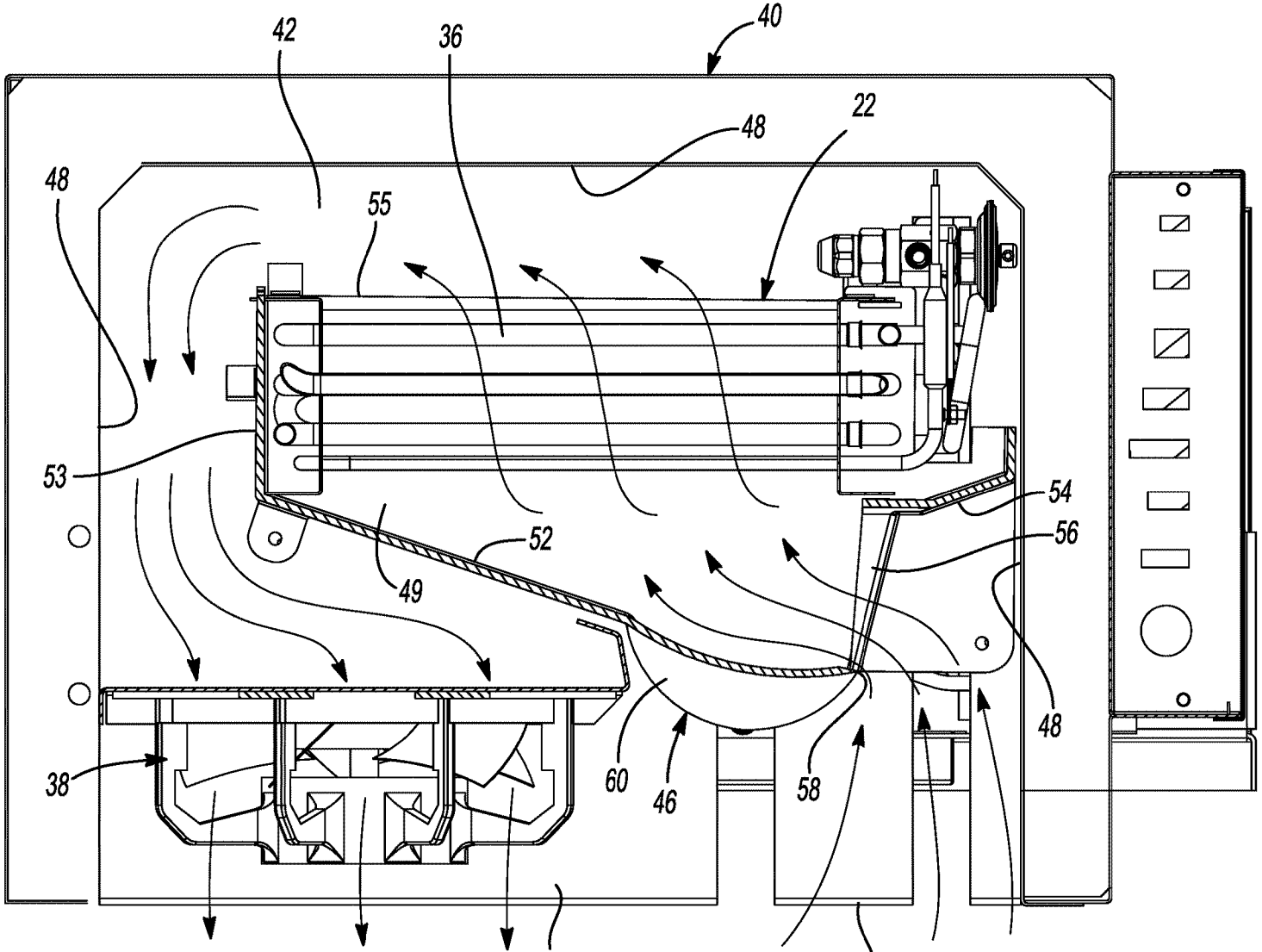
FIG. 5 is a cross-sectional view of the refrigeration system.

As shown in FIG. 5, the evaporator 22 and the second fan 38 may be disposed within a housing 40. The housing 40 may be a double-walled housing having an interior cavity 42 in which the evaporator 22 is disposed. The second fan 38 may also be disposed within the interior cavity 42. The housing 40 may include an opening 44 (or a plurality of openings) that may provide fluid communication between the interior cavity 42 and the space 14 within the refrigeration case 12. Operation of the second fan 38 may draw air from the space 14 through the opening 44 into the interior cavity 42, draw the air across the coil 36 of the evaporator 22 (where the air is cooled), and force the cooled air back into the space 14 through the second fan 38 through the opening 44 (or through a different opening in the housing 40).

Figure 4:
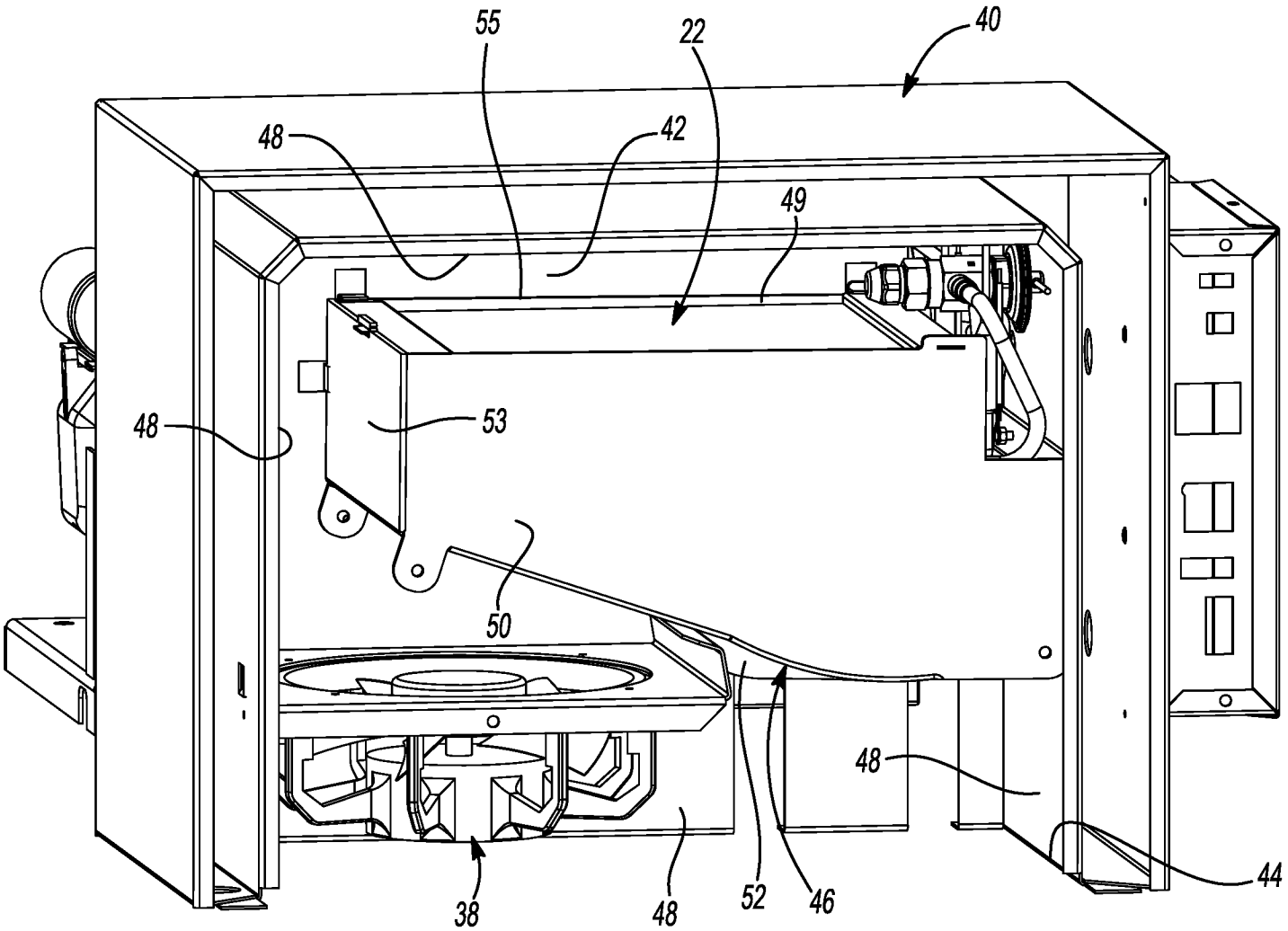
FIG. 4 is another perspective view of the refrigeration system with a panel of a housing removed to show a drain pan, evaporator and fan.

As shown in FIGS. 4 and 5, a drain pan 46 may be disposed within the housing 40. A portion of the drain pan 46 is disposed vertically beneath the evaporator 22 to collect and drain condensate (e.g., water) that drips off of the evaporator 22. As shown in FIGS. 4 and 5, the drain pan 46 may receive the evaporator 22 (e.g., the evaporator 22 may be disposed partially or entirely within the drain pan 46. As shown in FIG. 5, the coil 36 of the evaporator 22 is disposed in a generally horizontal configuration (i.e., the long lengths of the coil 36 extend generally horizontally). As shown in FIG. 5, the drain pan 46 cooperates with interior walls 48 of the housing 40 to define an airflow path through the housing 40. The drain pan 46 may be fixedly mounted to the housing 40 by threaded fasteners, dowel pins, and/or snap features, for example, or any other fastening means.

Figure 6:
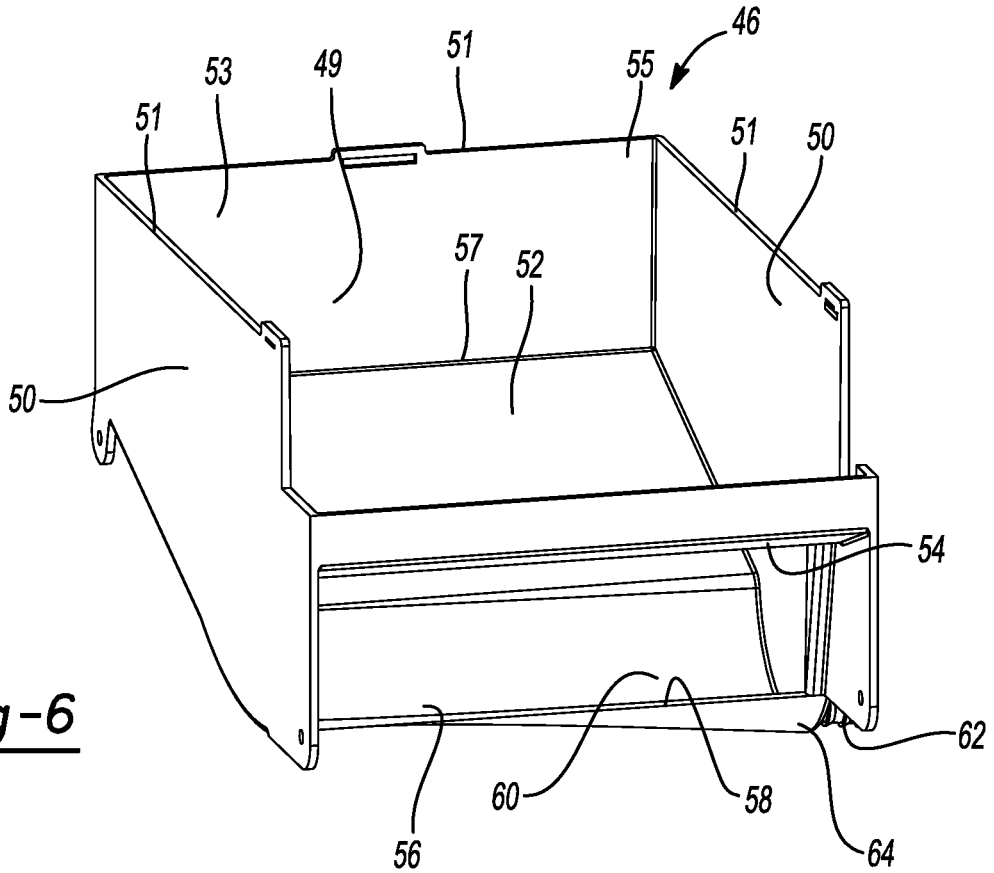
FIG. 6 is a perspective view of the drain pan.
Figure 7:
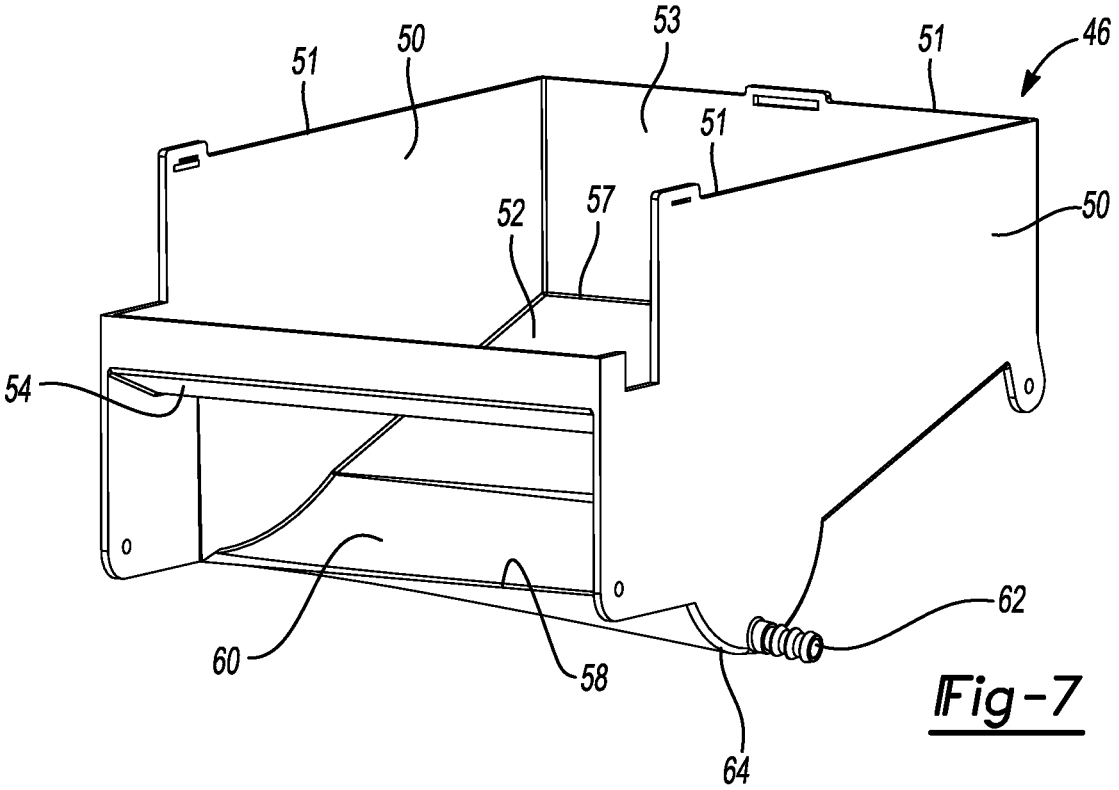
FIG. 7 is another perspective view of the drain pan.
Figure 8:
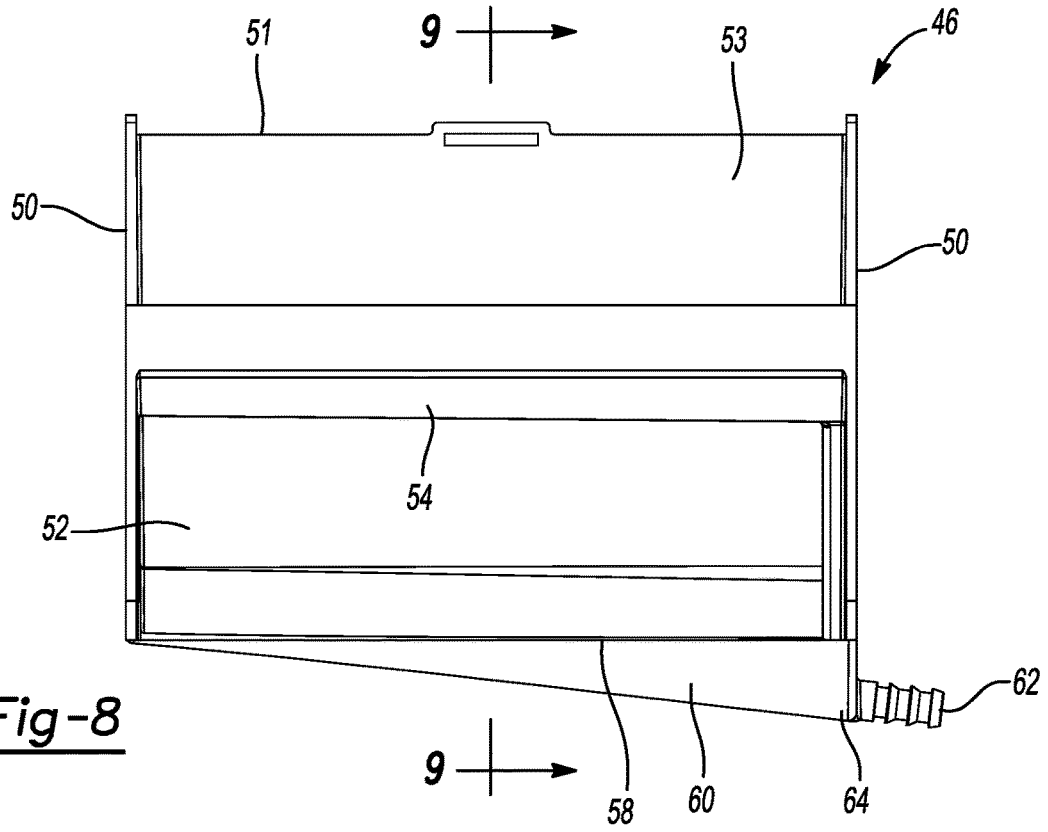
FIG. 8 is a front view of the drain pan.
Figure 9:
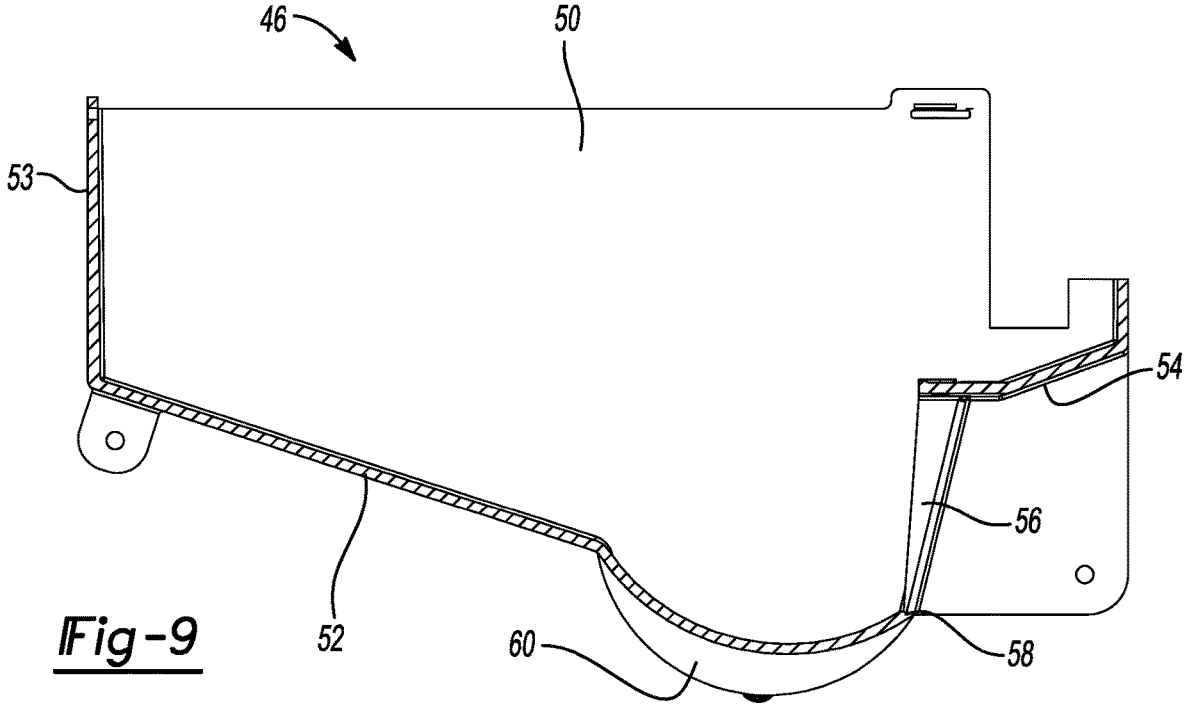
FIG. 9 is a cross-sectional view of the drain pan taken along line 9-9 of FIG. 8.

Referring now to FIGS. 6-10, the drain pan 46 may include a plurality of side walls 50, a lower wall 52, and a back wall 53 that cooperate to define a cavity 49 in which the evaporator 22 may be received. The lower wall 52 is disposed at lower ends of the side walls 50 and back wall 53. Upper ends 51 of the side and back walls 50, 53 (the ends opposite the lower wall 52) form an air outlet (e.g., an opening) 55 (FIGS. 4-6). A baffle 54 may extend between the two opposing side walls 50 at a location between the lower wall 52 and the upper end 51 of the side walls 50. An air inlet 56 (FIGS. 5 and 6) may be defined by the baffle 54, the opposing side walls 50, and a leading edge 58 of the lower wall 52.

The lower wall 52 may be inclined (disposed at a non-perpendicular angle) relative to the side and back walls 50, 53. That is, the lower wall 52 may be disposed at a non-perpendicular angle relative to the vertical direction (i.e., the direction of gravitational pull). A first end 57 of the lower wall 52 is attached to the back wall 53. The leading edge 58 of the lower wall 52 is disposed at the end opposite the first end 57. The lower wall 52 may include a trough or channel 60 formed therein adjacent the leading edge 58. The incline of the lower wall 52 is such that condensate that drips onto the lower wall 52 proximate the first end 57 (or between the first end 57 and the trough 60) will move down the lower wall 52 (under the force of gravity) and into the trough 60.

The trough 60 may be a curved or generally U-shaped so that condensate that flows down the inclined lower wall 52 may collect in the trough 60 instead of flowing over the leading edge 58. As shown best in FIGS. 6-8, a bottom of the trough 60 is angled toward a first one of the side walls 50. That is, the trough 60 is deeper at the first one of the side walls 50 than at the other one of the side walls 50. A drain outlet 62 may be disposed at or adjacent a deeper end (or vertically lower end) 64 of the trough 60. Condensate that drips onto the lower wall 52 will flow (under the force of gravity) away from the back wall 53 and into the trough 60. The condensate in the trough 60 will flow (under the force of gravity) toward the first one of the side walls 50 at the deeper end 64 and will flow out of the drain pan 46 through the drain outlet 62.

Referring now to FIG. 5, during operation of the refrigeration system 10, and more specifically, during operation of the second fan 38, air from the space 14 of the refrigeration case 12 flows up through the opening 44 of the housing 40, through the air inlet 56 of the drain pan 46 (the baffle 54 may help to direct airflow through the air inlet 56), and into the cavity 49 of the drain pan 46. The air inlet 56 is disposed vertically beneath the evaporator 22 so that the air can flow up and into a space between the lower wall 52 and the evaporator 22 before flowing through the evaporator 22. After flowing across the coil 36 of the evaporator 22, the air exits the drain pan 46 through the air outlet 55 of the drain pan 46. The air may then flow around the back wall 53 of the drain pan 46 (e.g., between the back wall 53 and one of the interior walls 48 of the housing 40), through the second fan 38 and back through the opening 44 and into the space 14 of the refrigeration case 12.

Figure 10:
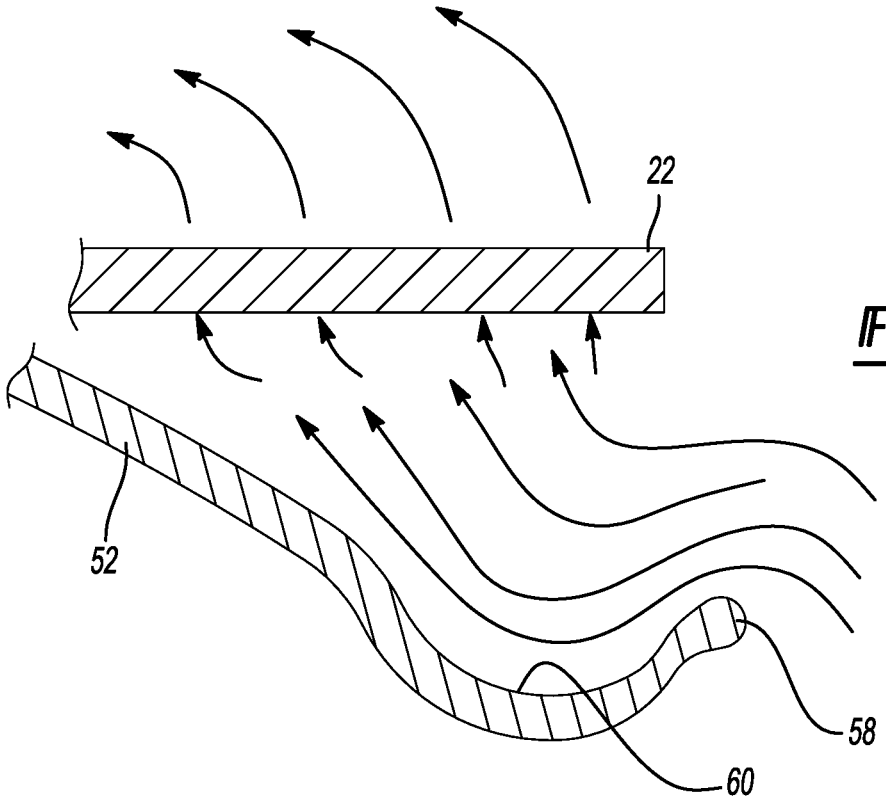
FIG. 10 is a schematic, partial cross-sectional view of the drain pan and evaporator.

As shown in FIG. 10, the leading edge 58 of the lower wall 52 can include the shape of an airfoil. The airfoil shape of the leading edge 58 can improve airflow through the air inlet 56 (e.g., around the leading edge 58). That is, the airfoil shape will decrease airflow separation from the lower wall 52 and reduce turbulence. That is, air flowing over the airfoil-shaped leading edge 58 will not separate (or at least separate to a lesser extent) from the lower wall 52, which will reduce or eliminate vortices in the air flow downstream of the leading edge 58 (i.e., eliminate or reduce vortices in the trough 60 of the lower wall 52). This will allow the air flow to be more laminar and reduce turbulence, which reduces static air pressure differentials allowing for better airflow which will allow greater heat transfer between the air and the evaporator coil 36.

In some configurations, one or more edges of the baffle 54 and/or other edges of the drain pan 46 may be airfoil-shaped to reduce or eliminate any vortices and improve airflow.

Referring now to FIGS. 11-15, an alternative drain pan 146 is provided that can be mounted in the housing 40 of the refrigeration system 10 instead of the drain pan 46. The structure and function of the drain pan 146 may be similar or identical to that of the drain pan 46 described above, apart from the differing features described below and/or shown in the figures. Therefore, descriptions of some similar features are not repeated.

Like the drain pan 46, the drain pan 146 may include a plurality of side walls 150, a lower wall 152, and a back wall 153 that cooperate to define a cavity in which the evaporator 22 may be received. The lower wall 152 is disposed at lower ends of the side walls 150 and back wall 153. A baffle 154 may extend between the two opposing side walls 150. An air inlet 156 (FIG. 11) may be defined by the baffle 154, the opposing side walls 150, and a leading edge 158 of the lower wall 152.

The lower wall 152 may be inclined (disposed at a non-perpendicular angle) relative to the side and back walls 150, 153. That is, the lower wall 152 may be disposed at a non-perpendicular angle relative to the vertical direction (i.e., the direction of gravitational pull). The lower wall 152 may include a trough or channel 160 formed therein adjacent the leading edge 58. The incline of the lower wall 152 is such that condensate that drips onto the lower wall 152 will move down the lower wall 152 (under the force of gravity) and into the trough 160.

Figure 13:
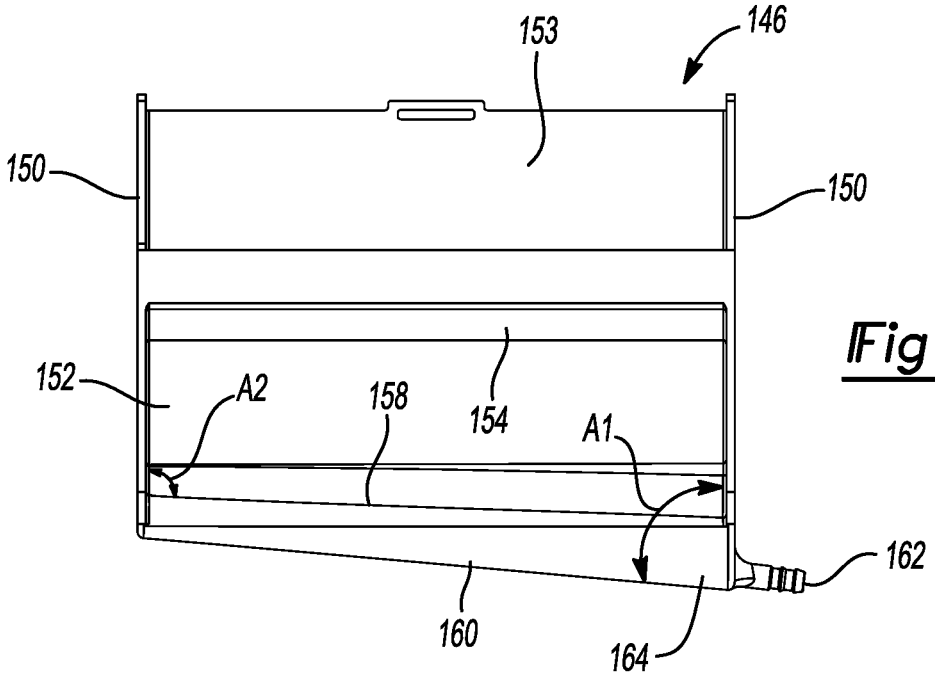
FIG. 13 is a front view of the drain pan of FIG. 11.

The trough 160 may be a curved or generally U-shaped so that condensate that flows down the inclined lower wall 152 may collect in the trough 160 instead of flowing over the leading edge 158. As shown in FIG. 13, a bottom of the trough 160 is angled toward a first one of the side walls 150. That is, the trough 160 is deeper at the first one of the side walls 150 than at the other one of the side walls 150. In other words, like the trough 60, the bottom of the trough 160 is disposed at a non-perpendicular angle A1 (FIG. 13) relative to the side walls 150. The trough 60 has a vertically lower end (or deeper end) 164 at the first one of the side walls 50 and a vertically higher end (or shallower end) 165 at the other one of the side walls 50. A drain outlet 162 may be disposed at or adjacent the vertically lower end 164 of the trough 160. Condensate that drips onto the lower wall 152 will flow (under the force of gravity) away from the back wall 153 and into the trough 160. The condensate in the trough 160 will flow (under the force of gravity) toward the first one of the side walls 150 at the vertically lower end 164 and will flow out of the drain pan 146 through the drain outlet 162.

As shown in FIG. 13, the leading edge 158 may be disposed at a non-perpendicular angle A2 relative to the side walls 150. In some configurations, the angle A2 could be the same angle as the angle A1. In other configurations, the angles A1 and A2 are different from each other.

Figure 11:
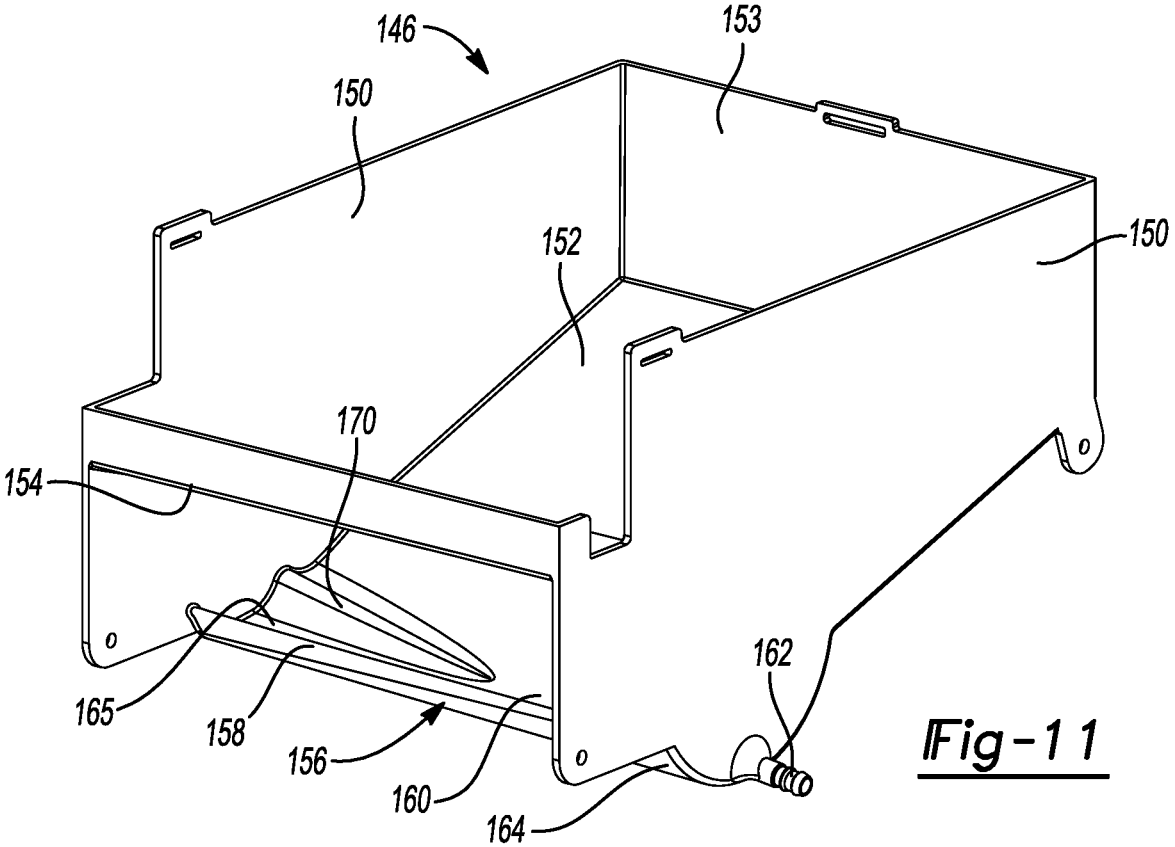
FIG. 11 is a perspective view of an alternative drain pain.
Figure 12:
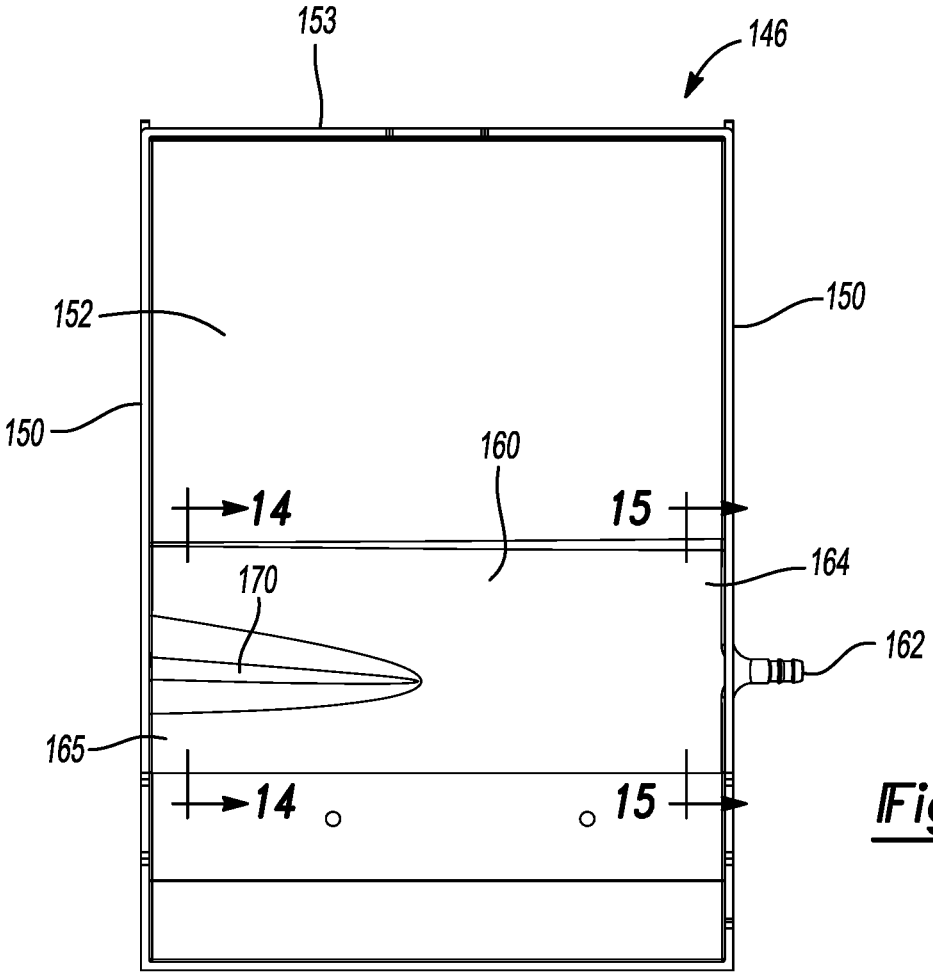
FIG. 12 is an overhead view of the drain pan of FIG. 11.

As shown in FIGS. 11 and 12, a deflector 170 may be disposed in the trough 160 at the vertically higher end 165. The deflector 170 may be sloped so that the size of the deflector 170 reduces as it extends toward the vertically lower end 164 of the trough. The deflector 170 directs water flowing into the trough 160 at the vertically higher end 165 toward the vertically lower end 164 and prevents water from running up side of the trough 160 and over the leading edge 158.

While the deflector 170 is shown in the figures as having a variable cross section, in some configurations, the deflector 170 could have a constant cross section. Furthermore, the deflector 170 could extend across the entire (or nearly the entire) width of the trough 160 (i.e., from the vertically higher end 165 to the vertically lower end 164).

While the center of the deflector 170 is shown in the figures extending generally parallel with the center or bottom of the trough 160, in some configurations, the center of the deflector 170 could be angled to further direct water in the trough 160 and/or to influence airflow across the trough 160.

In some configurations, a cross-sectional profile of the deflector 170 may have an airfoil shape to improve airflow across the trough 160. In other configurations, the cross-sectional profile of the deflector 170 may have a circular (or semi-circular) shape, a square or rectangular shape, a triangular shape, or another desired shape.

Figure 14:
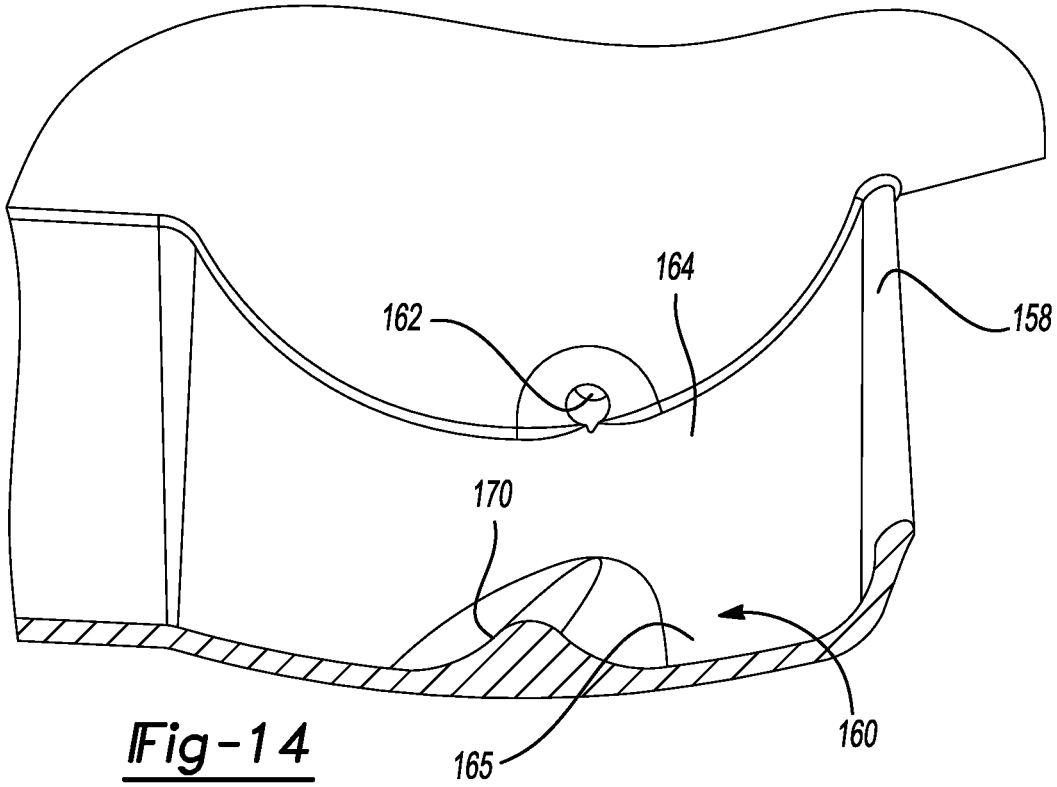
FIG. 14 is a partial cross-sectional view of the drain pan taken along line 14-14 of FIG. 12.
Figure 15:
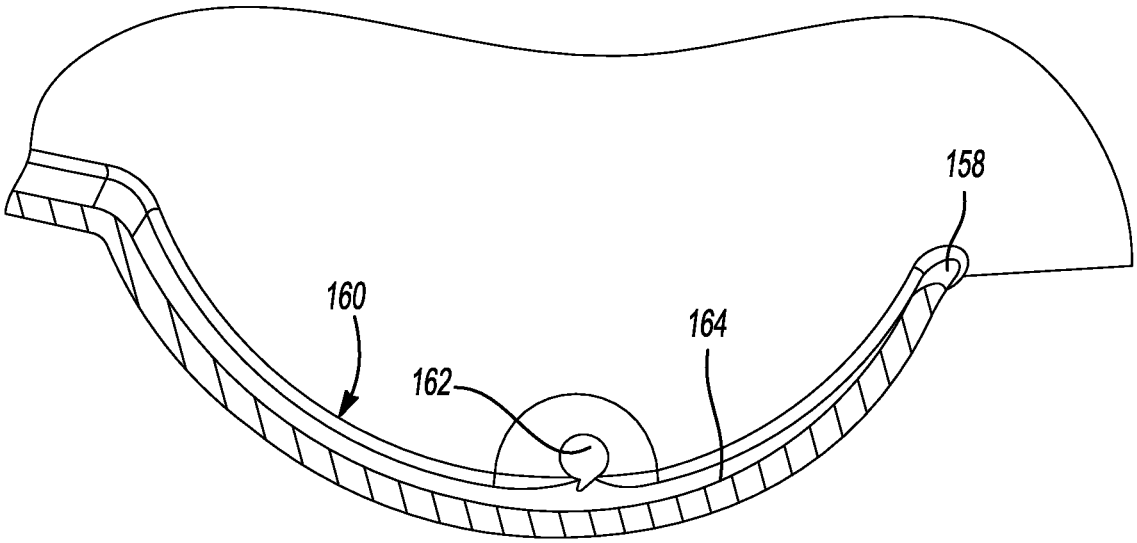
FIG. 15 is a partial cross-sectional view of the drain pan taken along line 15-15 of FIG. 12.

As shown in FIGS. 14 and 15, the leading edge 158 may have an airfoil-shaped cross-sectional profile. As described above, the airfoil shape improves airflow through the air inlet 156. As shown in FIGS. 14 and 15, an angle of attack of the airfoil profile may vary across the width of the drain pan 146. That is, the angle of attack of the airfoil profile may decrease as the leading edge 158 extends from the vertically higher end 165 of the trough 160 toward the vertically lower end 164 of the trough 160. Furthermore, a chord length of the airfoil profile varies across the width of the drain pan 146. That is, the chord length of the airfoil profile decreases as the leading edge 158 extends from the vertically higher end 165 of the trough 160 toward the vertically lower end 164 of the trough 160.

Having a higher angle of attack and a longer chord length of the leading edge 158 at the vertically higher end (i.e., the shallower end) 165 of the trough 160 reduces the likelihood that water will spill over leading edge 158. The angle of attack and chord length are reduced at the vertically lower end (i.e., the deeper end) 164 of the trough 160 to improve airflow at the vertically lower end 164 (where water retention is less of a problem).

It will be appreciated that in some configurations, the angle of attack of the leading edge 158 could be constant across the width of the drain pan 146 and/or the chord length of the leading edge 158 could be constant across the width of the drain pan 146.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a housing;

an evaporator disposed within the housing and including a coil;

a drain pan disposed within the housing and including a lower wall disposed vertically beneath the coil, wherein the drain pan includes a pair of opposing side walls and a back wall extending between the side walls, wherein the lower wall is attached to the side walls and the back wall, and wherein the lower wall is inclined and angled relative to the back wall, and wherein the lower wall defines a first airflow path underneath the coil; and a fan forcing air through the first airflow path, wherein the inclined lower wall includes a leading edge defining an air inlet into the drain pan, and wherein the leading edge includes an airfoil-shaped cross-sectional profile, wherein the lower wall includes a trough adjacent the leading edge, wherein the lower wall slopes vertically downward such that liquid flows downward under a force of gravity away from the back wall and into the trough, and wherein the leading edge defines an edge of the trough, wherein the back wall is spaced apart from the trough, wherein the lower wall extends from the trough to the backwall, wherein the drain pan includes a deflector disposed between the back wall and the leading edge and extending at least partially between the side walls, wherein the deflector is sloped so that a size of the deflector reduces as the deflector extends toward one of the side walls, and wherein a bottom of the trough is angled relative to the side walls such that the trough is deeper at a first one of the side walls than at a second one of the side walls.

2. The system of claim 1, wherein the leading edge is disposed at an end of the lower wall opposite an end of the lower wall that is attached to the back wall.

3. The system of claim 2, wherein a chord length of the airfoil-shaped cross-sectional profile varies across a width of the drain pan.

4. The system of claim 2, wherein an angle of attack of the airfoil-shaped cross-sectional profile varies across a width of the drain pan.

5. The system of claim 2, wherein the leading edge is disposed at a non-perpendicular angle relative to the side walls.

6. The system of claim 1, wherein the back wall of the drain pan and an interior wall of the housing cooperate to define a second airflow path downstream of the first airflow path and the coil.

7. The system of claim 6, wherein the second airflow path receives air from the coil and provides the air to the fan.

8. A system comprising:

a housing;

an evaporator disposed within the housing and including a coil;

a drain pan disposed within the housing and including a lower wall disposed vertically beneath the coil, the lower wall defining a first airflow path underneath the coil; and a fan forcing air through the first airflow path, wherein the drain pan includes a pair of opposing side walls and a back wall extending between the side walls, wherein the lower wall is attached to the side walls and the back wall, and wherein the lower wall is inclined and angled relative to the back wall, wherein the lower wall includes a trough, and wherein a bottom of the trough is angled relative to the side walls such that the trough is deeper at a first one of the side walls than at a second one of the side walls, wherein the back wall is spaced apart from the trough, wherein the lower wall includes a leading edge defining an air inlet into the drain pan, wherein the lower wall slopes vertically downward such that liquid flows downward under a force of gravity away from the back wall and into the trough, and wherein the leading edge defines an edge of the trough, wherein the lower wall extends from the trough to the backwall, wherein the leading edge includes an airfoil-shaped cross-sectional profile, wherein the leading edge is disposed at an end of the lower wall opposite an end of the lower wall that is attached to the back wall, wherein a chord length of the airfoil-shaped cross-sectional profile varies across a width of the drain pan, wherein an angle of attack of the airfoil-shaped cross-sectional profile varies across the width of the drain pan, wherein the leading edge is disposed at a non-perpendicular angle relative to the side walls, wherein the drain pan includes a deflector disposed in the trough and extending at least partially between the side walls, and wherein the deflector is sloped so that a size of the deflector reduces as the deflector extends toward a vertically lower end of the trough.

9. The system of claim 8, wherein the back wall of the drain pan and an interior wall of the housing cooperate to define a second airflow path downstream of the first airflow path and the coil.

10. The system of claim 9, wherein the second airflow path receives air from the coil and provides the air to the fan.

* * * * *